United States Patent [19]

Crum

[11] Patent Number: 4,827,389

[45] Date of Patent: May 2, 1989

[54] PORTABLE LIGHT

[76] Inventor: Donald D. Crum, 717 W. 1st St., Ogallala, Nebr. 69153

[21] Appl. No.: 56,956

[22] Filed: Jun. 3, 1987

[51] Int. Cl.[4] ..... F21V 21/08; F21V 21/30

[52] U.S. Cl. ..... 362/388; 362/418; 362/431

[58] Field of Search ..... 362/388, 418, 430, 431; 248/156

[56] References Cited

U.S. PATENT DOCUMENTS

| | | | |
|---|---|---|---|
| Re. 26,995 | 12/1970 | Guggemos | 362/431 X |
| 240,663 | 4/1881 | Coleman | 362/431 |
| 1,140,192 | 5/1915 | Shaw | 362/431 |
| 1,508,206 | 9/1924 | Waters | 362/431 X |
| 2,195,391 | 3/1940 | Hunter | 248/156 |
| 2,922,031 | 1/1960 | Stiffel | 362/431 |
| 3,197,631 | 7/1965 | Jensen | 362/431 |
| 3,291,977 | 12/1966 | Nafe | 362/430 X |
| 3,721,516 | 4/1973 | Reese | 362/431 X |
| 4,049,959 | 9/1977 | Ledterman | 362/431 X |
| 4,099,222 | 7/1978 | Cornell et al. | 362/431 X |

*Primary Examiner*—Tony M. Argenbright
*Assistant Examiner*—Eric R. Carlberg
*Attorney, Agent, or Firm*—Rogers & Killeen

[57] ABSTRACT

A portable light, adapted for night fishing from a boat or from the shore. The light illuminates the fishing area from above using plural lighting means powered by a portable power supply such as a battery. The structure supporting the light is collapsible for hand-carry, and has interchangeable mounting attachments; a spike for use ashore and two platforms, one horizontal and one vertical, for mounting on a boat or other surface.

6 Claims, 3 Drawing Sheets

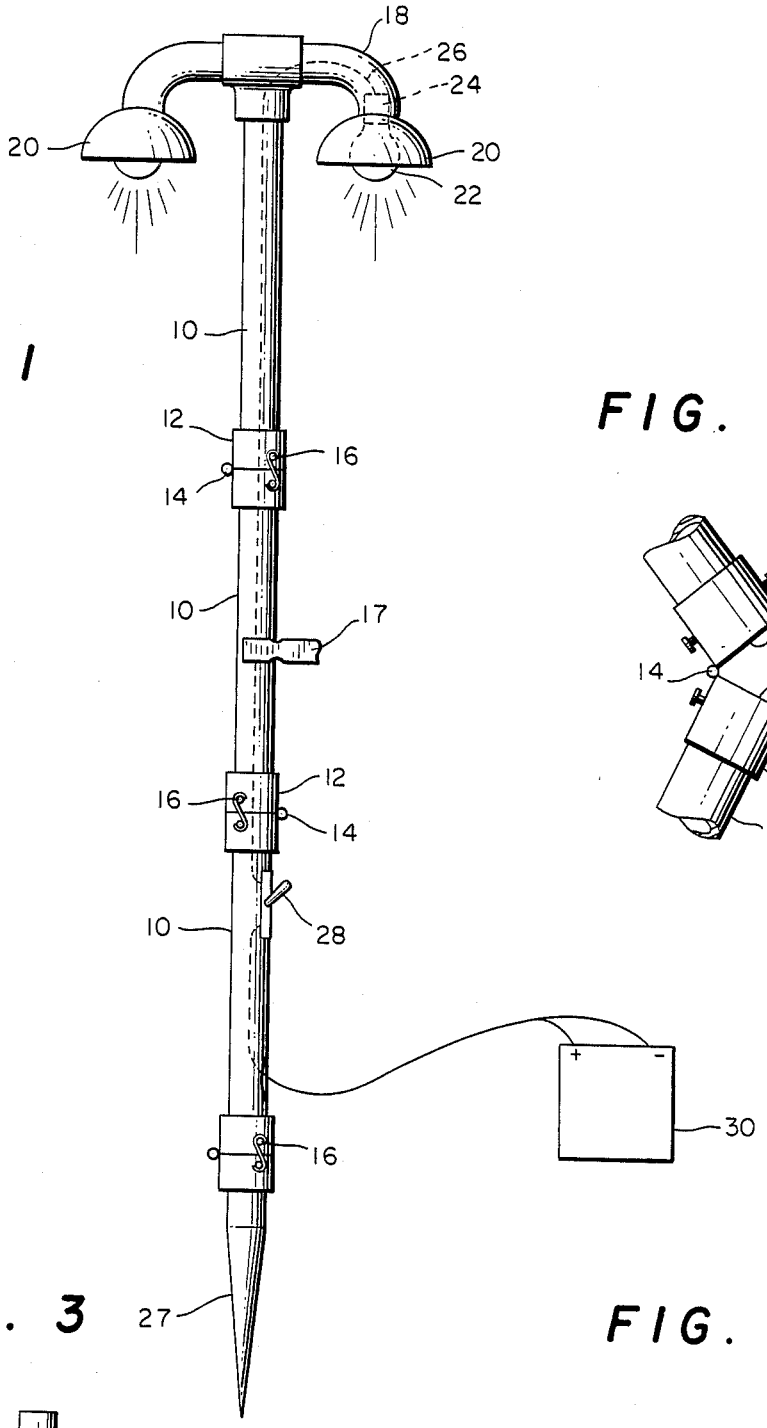
FIG. 1
FIG. 2
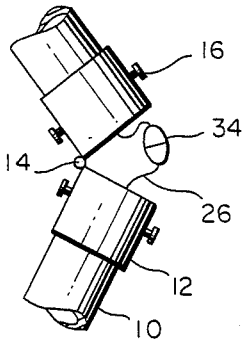
FIG. 3
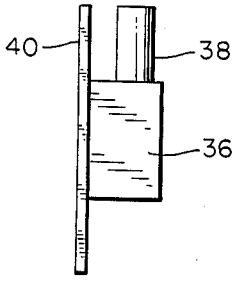
FIG. 4
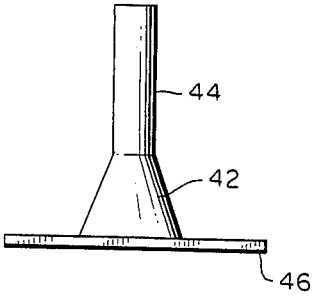

PORTABLE LIGHT

BACKGROUND OF THE INVENTION

The present invention relates to a portable light, and more particularly to a portable light adapted for night fishing from a boat or from land.

Night fishing is a popular sport in many areas of the country. Much of this fishing is done from small boats or in remote areas away from conventional sources of electricity. Providing a safe source of adequate light in a hand-portable device requiring little maintenance, however, has been a problem. Traditional alcohol or kerosene fueled lanterns often do not provide enough light to adequately illuminate the entire fishing area or require refueling. Refueling in a boat can be especially hazardous due to the danger of fire. Further, many lanterns require periodic cleaning and wick replacement.

Portable lighting devices that do provide adequate light are often large and difficult to transport. Other known portable lights sometimes spill excessive amounts of light onto the water, thereby scaring off certain types of fish from the viciinity of the fisherman.

Another problem, albeit one common with many lights, is that they attract insects. Most portable lights provide sources of light close to the people receiving the benefit of the light, thus attracting insects to the people. For example, anchor lights, required for small boats in many states, are only one or two feet above the boat. Not only do they attract insects close to the poeple in the boat, they tend to shine in the eyes of the boaters.

Portable lighting devices are well known. The night fishing device disclosed in the Reeder U.S. Pat. No. 3,064,122, dated Nov. 13, 1962, directs one source of light into the water to attract fish, but provides only a small amount of light to illuminate the interior of the boat. It is adapted to be used only on boats.

Jensen U.S. Pat. No. 3,197,631, dated July 27, 1965, discloses a portable outlet extension and work lamp for use on a construction site. It is not readily adaptable for use on a small boat and requires an electrical power source suitable for use with power tools.

The overhead bike light in the Ledterman U.S. Pat. No. 4,049,959, dated Sept. 20, 1977, provides a small amount of overhead lighting but does not include alternate attachment schemes for use in a boat or ashore where there are no mounting brackets available.

The lighting devices disclosed in the Gossawiller U.S. Pat. No. 4,488,209, dated Dec. 11, 1984, and in the Dimiceli U.S. Pat. No. 4,363,084, dated Dec. 7, 1982, include flood lamps mounted on heavy devices carried on trucks or cars for use at the site of an emergency such as a forest fire or automobile accident. Neither device, however, is particularly suited for use on a small boat and neither is hand-portable.

It is, accordingly, an object of the present invention to provide a novel lighting apparatus which is both portable and may be mounted on a variety of surfaces.

It is another object of the present invention to provide a novel lighting system which may be collapsed to provide ease of portability.

It is still another object of the present invention to provide a portable lighting system in which the sources of illumination are sufficiently removed from the user of the light to avoid attracting insects to the person of the user.

It is yet another object of the present invention to provide a novel lighting system which is not dependent on outside sources of power.

It is still a further object of the present invention to provide a novel lighting system in which the illumination is provided within a narrowly defined field.

These and many other objects and advantages will be readily apparent to one skilled in the art to which the invention pertains from a perusal of the claims and the following detailed description of preferred embodiments read in conjunction with the appended drawings.

BRIEF DESCRIPTION OF THE DRAWINGS

FIG. 1 is a pictorial representation of a portable lighting system in accordance with the present invention;

FIG. 2 is a pictorial representation of the hinged joint of the lighting system of FIG. 1;

FIG. 3 is a pictorial representation of a mounting bracket which may be used with the lighting system of FIG. 1;

FIG. 4 is a pictorial representation of a mounting stand which may be used with the lighting system of FIG. 1;

DETAILED DESCRIPTION OF THE PREFERRED EMBODIMENTS

Figure 5:
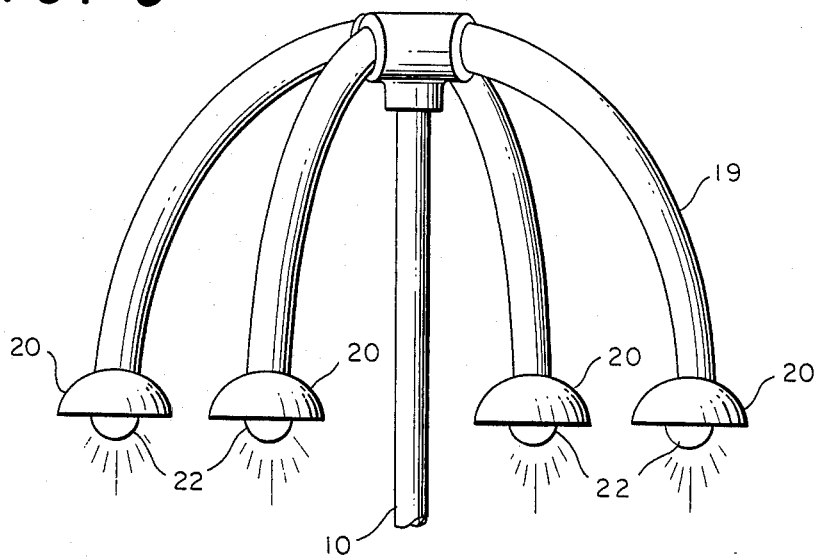
FIG. 5 is a pictorial representation of the top portion of a second embodiment of a lighting system in accordance with the present invention.

With reference to FIG. 1, a lighting system in accordance with the present invention may include plural, elongated members 10 arranged end-to-end in a substantially coaxial and vertical fashion. The ends of adjacent members may be interconnected through a hinged coupling 12. The hinged coupling includes a hinge 14 and a retainer 16. A yoke 18 may be attached to the upper portion of the uppermost member 10. At the distal ends of the yoke 18 are connected light protectors 20. The light connectors 20 may be concave downward with sufficient room at the interior thereof for a lightbulb 22. The interior of the protectors 20 also includes a socket 24 adapted to receive the base of the bulb 22. The socket may be connected through an electrical wire 26 to a switch 28 and through the switch to a source of electrical power 30.

At the bottom of the bottommost member, means may be provided for mounting the lighting system. A spike mount 27 may be used to be driven into a soil surface to hold the lighting system in a generally vertical orientation.

The lighting system of FIG. 1 is hinged in order to improve its portability. The retainers 16 can be released to allow the hinges 14 to operate and allow the elongated members 10 to assume positions generally parallel to each other. In this way a tall and relatively unweildy lighting system when erected may be collapsed into a more easily handled and transported system. The hinges 14 and retainers 16 may be any suitable conventional hinges and retainers. Alternatively, the hinges may be eliminated altogether so that the lighting system may be disassembled member by member.

Figure 7:
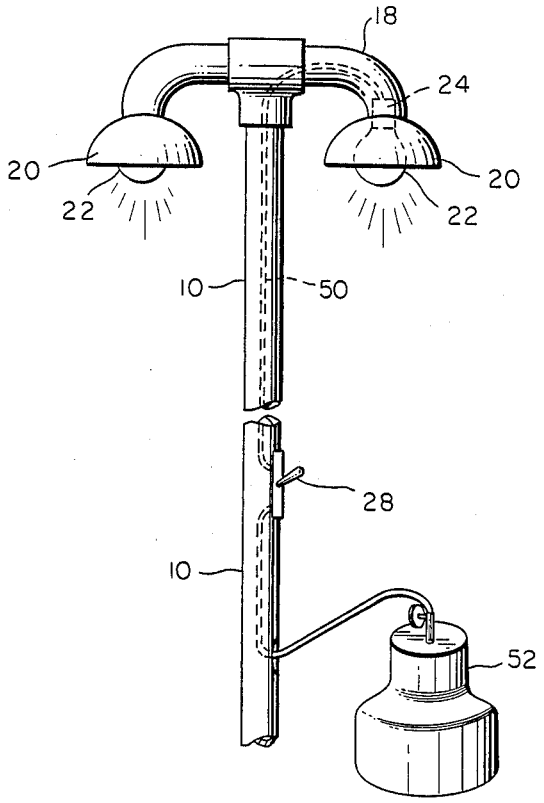
FIG. 7 is a pictorial representation of an embodiment of the lighting system of the present invention using a gas powered bulb.

When erected, the illumination is provided by the lightbulbs 22 within the light protectors 20. The lightbulbs 22 may be electric powered by means of the powerline 26 which is connected through the switch 28 through the battery 30. Alternatively, as may be seen in FIG. 7 the lightbulb may be a gas powered bulb connected by a powerline of flexible tubing 50 to a source of natural gas 52 through a switch 28.

The interior of the light protectors 20 may be coated with a reflective surface to increase the amount of illumination provided in the downward direction. Additionally, the lightbulb 22 may be covered with a lens (not shown) to focus or diffuse the illumination as desired for the particular application of the lighting system.

Figure 6:
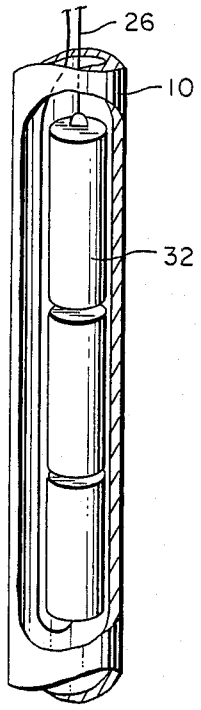
FIG. 6 is a pictorial representation of an alternative power source storage arrangement which may be used with the lighting system of FIG. 1.

The power source 30 may be a conventional 12 volt battery as is commonly found in boats or any other convenient source of power. As may be seen in FIG. 6 optionally, a well may be created in one of the elongated members 10 to hold internal batteries 32 for powering the portable lights.

When used by a fisherman, the lighting system may be carried conveniently by the fisherman to the desired shore location and the members 10 can be erected into their aligned configuration. The entire lamp may then be forced into the ground with the aid of a spike mount 26. By providing a relatively high position for the bulbs 22, a fisherman may avoid the bother of insects which are attracted to the bulbs and not to the fisherman. Moreover, by the use of the downwardly pointing light protectors 20 and optional lenses, the illumination may be confined to a desired location, avoiding a spill of lighting into the waters which may disturb the fish or other animals.

The height of the lighting system may be varied by the use of U-shaped retaining clamps 17 carried by selected-members 10. The retaining clamps 17 securely hold two longitudinally adjacent members 10 in parallel to reduce the height of the lighting system by the length of two members.

With reference to FIG. 2, wherein like elements have received like numerals as are utilized in FIG. 1, the powerline 26 may be broken at locations proximate to the ends of the members 10 and provided with a plug and socket interconnection 34 or similar arrangement so that the powerline 26 may be disconnected while the fishing lighting system is being carried and the powerline 26 is therefore not exposed outside of the protective members or forced to negotiate a 180 degree change in direction.

With reference to FIG. 3, a mounting bracket 36 may be utilized in connection with the lighting system of the present invention. The bracket 36 contains a receiving section 38 adapted to receive the bottom member of the lighting system and securely retaining the bottom member therein. The receiving section 38 is attached to a mounting plate 40 which may be attached in a conventional manner, such as through screws or adhesive, to a generally upright surface on a boat or other platform. The receiving section 38 may include a locking means (not shown) to further secure the lighting system within the receiving section 38.

With reference to FIG. 4, a standing bracket 42 includes a receiving section 44 which is adapted to receive and retain the bottom member of the lighting system. The receiving section 44 is mounted perpendicularly to a bottom plate 46 which is sufficient in dimension to provide stability to the lighting system when the lighting system is received within the receiving section 44 of the standing bracket 42. The receiving section 44 may optionally include a conventional locking means to additionally secure the lighting system within the standing bracket 42. Additionally, the full bracket may be permanently affixed to a generally horizontal surface through any conventional means such as screws through the floor plate 46 or an adhesive attached to the bottom surface of the floor plate 46.

With reference to FIG. 5, a lighting system of the present invention may include more or fewer lights than the lighting system shown in FIG. 1. For example, in the lighting system of FIG. 5, a lightbulb 22 depends from a relatively longer downwardly depending arm 19 and light protector 20 on each of four downwardly depending arms 19. The arrangement of the arms 19, light protectors 20 and lightbulbs 22 along with the optional lenses (not shown) and/or light deflectors (not shown) provides a source of illumination with particular characteristics advantageous to fisherman in directing light to specific points without drawing insects and without unnecessarily disturbing aquatic life.

The invention has been described herein in detail through various preferred embodiments. Additional variations available in all embodiments have been indicated. Other variations and embodiments will be evident to those skilled in this art. Accordingly, it is intended that all variations within the true scope of the invention are to be covered in the following claims.

I claim:

1. A portable light comprising:

plural hollow longitudinal members arranged approximately co-axially;

plural hinged connectors connecting adjacent longitudinal ends of said members and maintaining said members in approximate co-axial relationship when the hinges are in a first position and in approximate parallel relationship when the hinges are in a second position;

plural downwardly depending members connected to the free end of the uppermost longitudinal member;

a downwardly opening light protector connected to the free end of each said depending members;

lighting means positioned within the opening of each said protector and at the end of each said depending member;

a portable power supply;

a segmented power conductor internal to said members operatively connecting said power to each of said lighting means;

plural power conductor connections adjacent said hinged connectors for removably attaching said segments of power conductor;

a switch operatively connected to said power conductor to control the amount of power supplied to said lighting means; and a tapered mounting rod hingedly connected to the bottom of the lowermost longitudinal member, said mounting rod adapted to readily penetrate the ground.

2. The portable light of claim 1 wherein the power supply is an electrical battery and the power conductor is an electrical conductor.

3. The portable light of claim 1 wherein the power supply is a source of flammable gas and the power conductor is a hollow, flexible tube.

4. The portable light of claim 2 wherein the portable power source comprises commercially available cylindrical power cells positioned inside said one of the longitudinal members.

5. The portable light as defined in claim 1 further comprising a horizontal mounting platform for removably receiving and retaining said mounting rod in a position approximately perpendicular to a horizontal surface.

6. The portable light as defined in claim 1 further comprising a vertical mounting platform for removably receiving and retaining said mounting rod in a position approximately parallel to a vertical surface.

* * * * *